US006039398A

United States Patent [19]

Gorgi et al.

[11] Patent Number: 6,039,398

[45] Date of Patent: Mar. 21, 2000

[54] DEVICE FOR ADJUSTING THE INCLINATION OF THE BACK-REST RELATIVE TO THE SEATING PORTION IN CHAIRS IN GENERAL

[75] Inventors: Claudio Gorgi; Claudio Taverna, both of Rossano Veneto, Italy

[73] Assignee: Imarc S.p.A., Rossano Veneto, Italy

[21] Appl. No.: 09/091,482

[22] PCT Filed: Dec. 20, 1996

[86] PCT No.: PCT/EP96/05795

§ 371 Date: Sep. 14, 1998

§ 102(e) Date: Sep. 14, 1998

[87] PCT Pub. No.: WO97/23152

PCT Pub. Date: Jul. 3, 1997

[30] Foreign Application Priority Data

Dec. 22, 1995 [IT] Italy ..... VE95A0051

[51] Int. Cl.[7] ..... B60N 2/22

[52] U.S. Cl. ..... 297/354.1; 297/362.12; 297/301.4

[58] Field of Search ..... 297/354.12, 361.1, 297/362.12, 362.14, 362.11, 301.4, 301.5, 301.7, 302.7, 302.4, 300.8, 354.1

[56] References Cited

U.S. PATENT DOCUMENTS 3,018,992 1/1962 Lore ..... 248/180.1
4,576,410 3/1986 Hattori ..... 297/361.1 X

FOREIGN PATENT DOCUMENTS 445755 2/1968 Switzerland ..... 297/300.1

*Primary Examiner*—Peter M. Cuomo
*Assistant Examiner*—David E Allred
*Attorney, Agent, or Firm*—Hoffman, Wasson & Gitler, PC

[57] ABSTRACT

A device for adjusting the inclination of the back-rest to the seating portion in chairs in general, comprising a first structural element rigid with the seating portion and a second structural element rigid with the back-rest and hinged to the first structural element on a transverse axis characterized in that with one of the two structural elements there is associated a first member provided with an inclined surface and rotating about an axis which intersects the transverse hinging axis, with the other of the two structural elements here being associated a second member maintained constantly in contact with the inclined surface for any angular position of the first member.

12 Claims, 11 Drawing Sheets

DEVICE FOR ADJUSTING THE INCLINATION OF THE BACK-REST RELATIVE TO THE SEATING PORTION IN CHAIRS IN GENERAL

FIELD OF THE INVENTION

This invention relates to a device for adjusting the inclination of the back-rest relative to the seating portion in chairs, and in particular in working chairs for video terminal operators, typists, etc.

BACKGROUND OF THE INVENTION

Working chairs are known, widely used by video terminal operators, typists, etc. Because of the different requirements of different operators and the different utilization conditions, the chair must be able to be adjusted on the basis of these requirements. They must provide each operator with the most comfortable conditions. This is essential because of the lengthy periods for which they are in continuous use.

One of the most frequently required adjustments for working chairs relates to the rearward inclination of the back-rest relative to the seating position.

This adjustment is currently achieved by hinging together a chair structural element rigid with the back-rest and a chair structural element rigid with the seating portion on a vertical axis. The two structural elements have slotted plates, alternating with each other, which are traversed by a single pin and maintained together, able to lock the seating portion and back-rest together in the desired position.

It is also known to interpose between the seating portion and back-rest a spring which, in the absence of other forces, maintains the back-rest in an erect position relative to the seating portion. This position is changeable by a rearward thrust by the operator, followed by locking in the desired position.

A drawback of this known arrangement is that locking the back-rest relative to the seating portion requires a certain force and is uncomfortable for persons lacking strength.

A further drawback is that if the plates are not correctly locked, the back-rest is free to incline relative to the seating portion.

A further drawback is that the locking device requires a large number of parts to be assembled together.

In order to eliminate or at least attenuate these drawbacks, and in particular to facilitate the locking of the palates, it has been proposed to replace the knob associated with the screw means with a spring which maintains the pack plates coupled together and is associated with a lever or eccentric for it temporary deactivation.

This arrangement has proved more advantageous than the preceding but has not eliminated the drawbacks of having a large number of components to be assembled together and the need for the operator to set the back-rest into the desired position by means of his back.

Moreover, in known working chairs it is often requested that in addition to being adjustable relative to the seating portion when in the non-loaded state, the back-rest is also elastically rearwardly yieldable, with the degree of yieldability adjustable on the basis of the weight of the person seated. This is generally achieved by using the spring that returns the backrest into the erect position, when the members for locking the back-rest to the seating portion are deactivated.

A drawback of this arrangement is that using the same spring both for returning the back-rest into the erect position during its adjustment and for counteracting the rearward elastic yielding of the back-rest means that this spring unnecessarily stresses the back-rest inclination adjustment members. These members in themselves do not require any stressing, with the result that they have to be unnecessarily over-dimensioned.

A further drawback is that when the chair is not loaded, i.e., without an operator seated on it, and the member which locks the back-rest relative to the seating portion is voluntarily or accidentally slackened, the return spring, which is sized for a person, suddenly returns the back-rest into the erect position, with possible personal harm.

Another drawback is that if the system for adjusting the rearward inclination of the back-rest is stressed directly by a spring, it becomes difficult to adjust. The adjustment point is determined by the condition of balance between the two opposing forces due, on one hand to the rearward thrust by the operator and, on the other hand, to the elastic reaction of the stressed spring.

SUMMARY OF THE INVENTION

An object of the invention is to eliminate these drawbacks by providing a device for adjusting the back-rest relative to the seating portion of a working chair, which requires a very small number of parts to be assembled together.

A further object of the invention is to provide an adjustment device which is easily operable by the operator without exerting considerable force.

A further object of the invention is to provide an adjustment device which enables the back-rest to be inclined in both directions relative to the seating portion without using springs or other mechanical systems and at the same time not requiring the user to exert a thrust with his back.

A further object of the invention is to provide an adjustment device offering controlled rearward yielding of the chair back-rest, with a degree of yielding adaptable to the user's weight.

All these objects and further ones which will result from the following description are attained according to the invention through a device for adjusting the inclination.

BRIEF DESCRIPTION OF THE DRAWINGS

Two preferred embodiments of the present invention are further described hereinafter with reference to th4 accompanying drawings, in which.

DETAILED DESCRIPTION OF THE INVENTION

Figure 1:
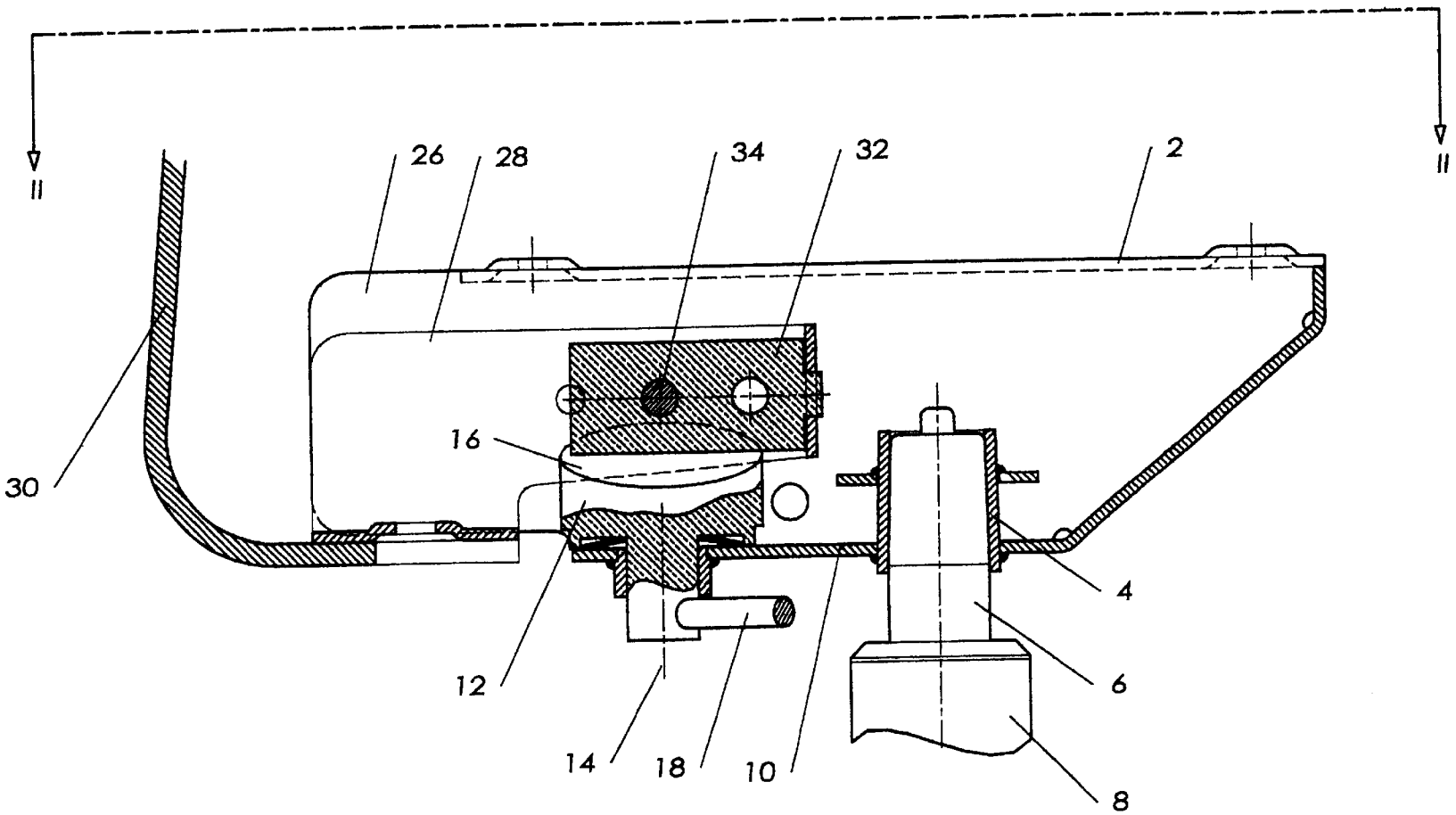
FIG. 1 is a schematic longitudinal section through a first embodiment of the adjustment device taken on the line I—I of FIG. 2.
Figure 2:
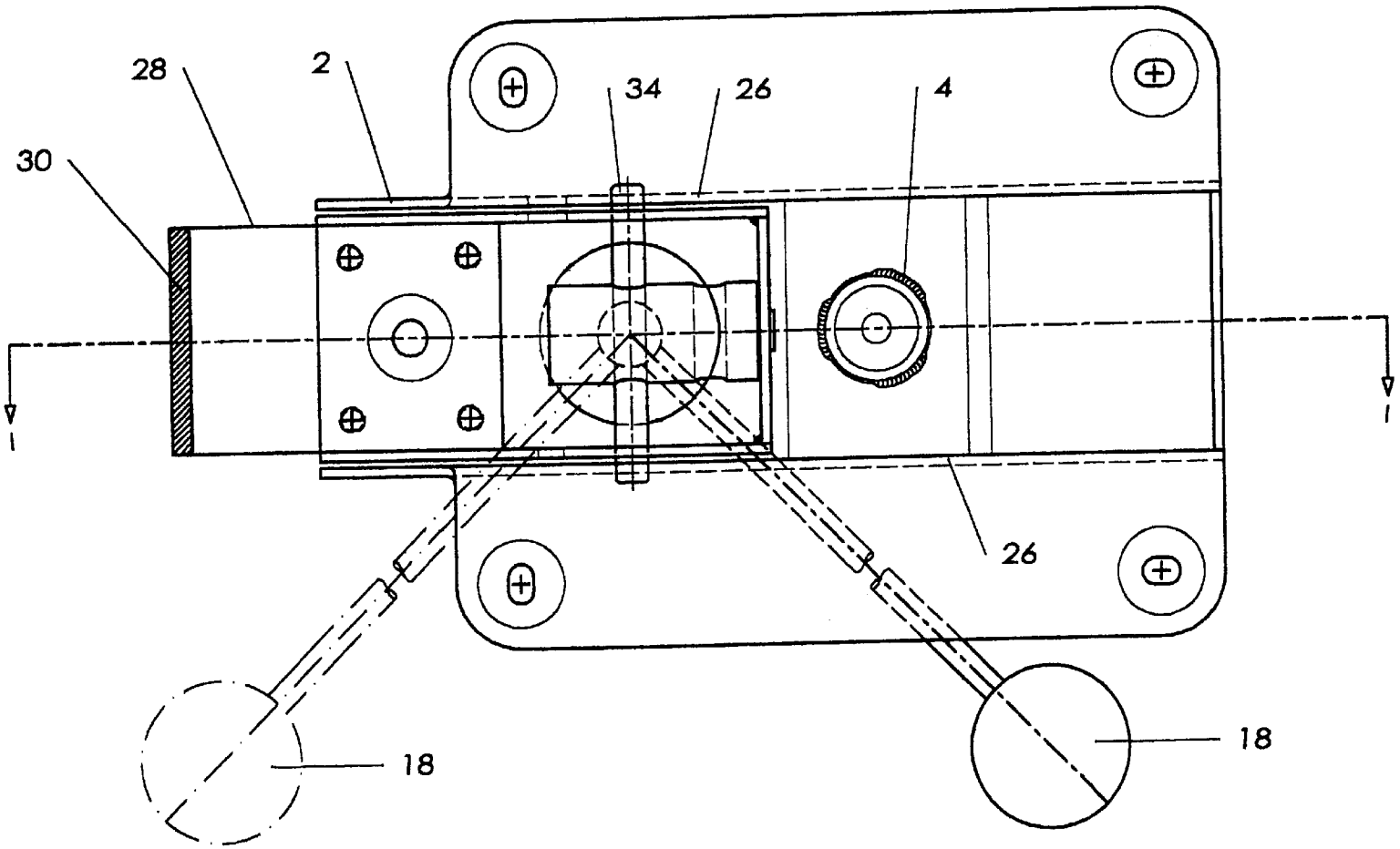
FIG. 2 is a plan view thereof to a reduced scale taken in the direction II—II of FIG. 1.
Figure 3:
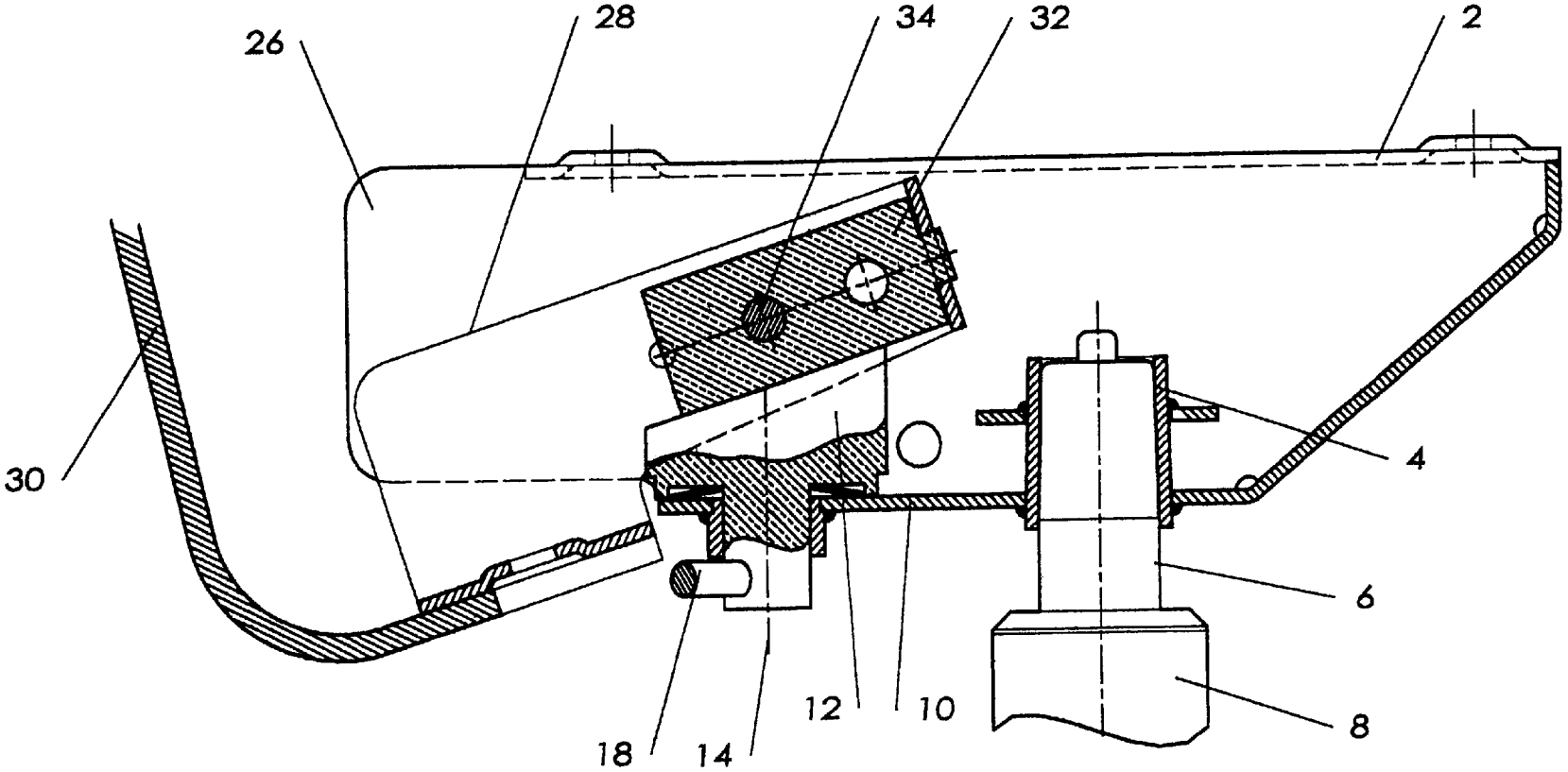
FIG. 3 shows the same view as FIG. 1 but in the configuration in which the back-rest is inclined rearward to its maximum extent.

As can be seen from the figures, the adjustment device according to the invention in FIGS. 1–3 comprises a box structure 2 attached to the lower surface of the seating portion of a chair and provided with a frusto-conical sleeve 4, into which the rod of a gas spring 8 can be inserted to adjust the height of the seating portion from the chair base. As the operating and adjustment members for the gas spring 8 are traditional, they have been omitted from the drawings for simplicity of representation.

A cylindrical member 12 having a vertical axis 14, with its lower end perpendicular to the axis is adhered to the base 10 of the box structure. Its upper end 16 is inclined.

Figure 4:
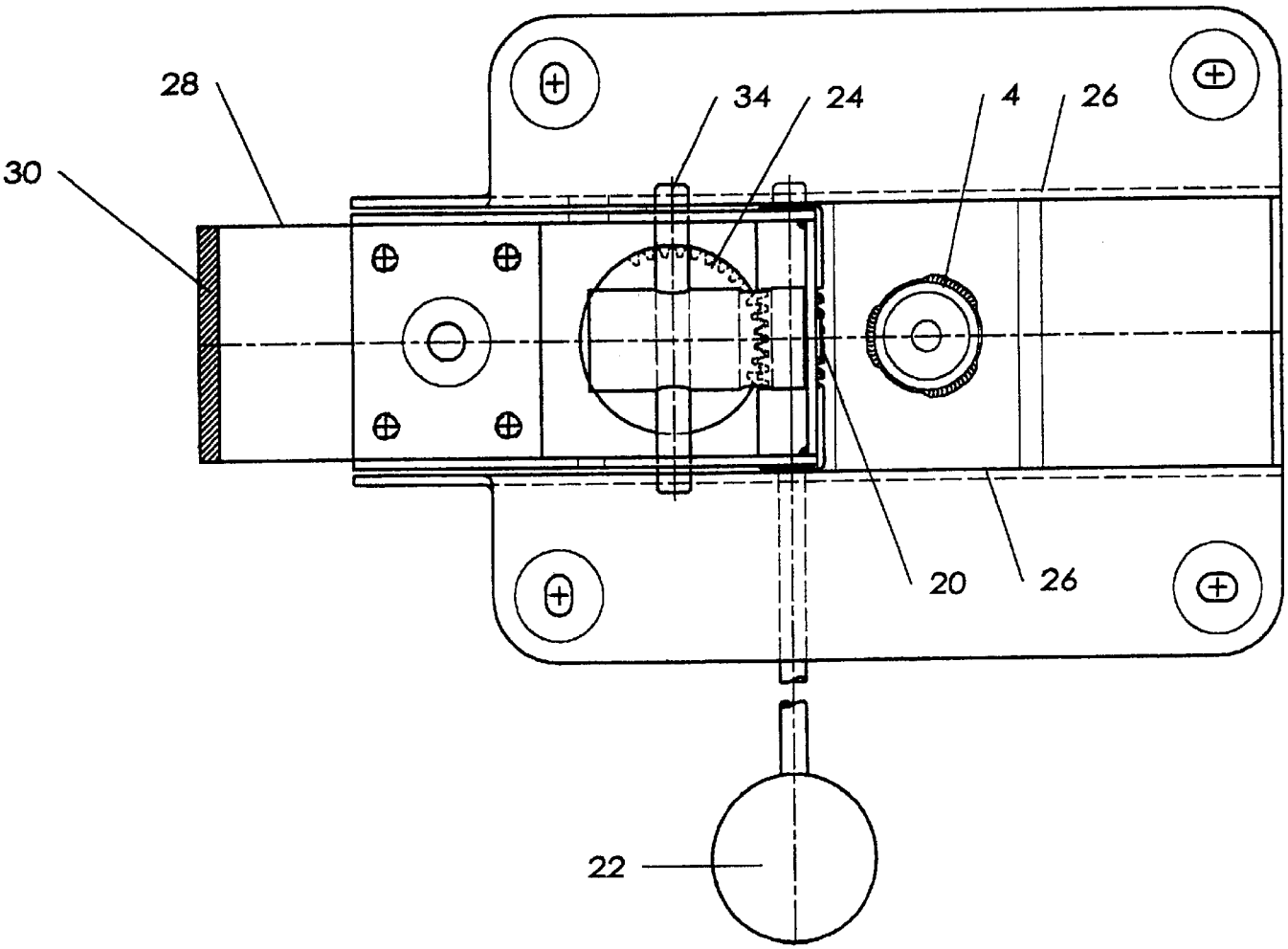
FIG. 4 shows it in the same view as FIG. 2, but with a different member for operating the inclined surface.
Figure 5:
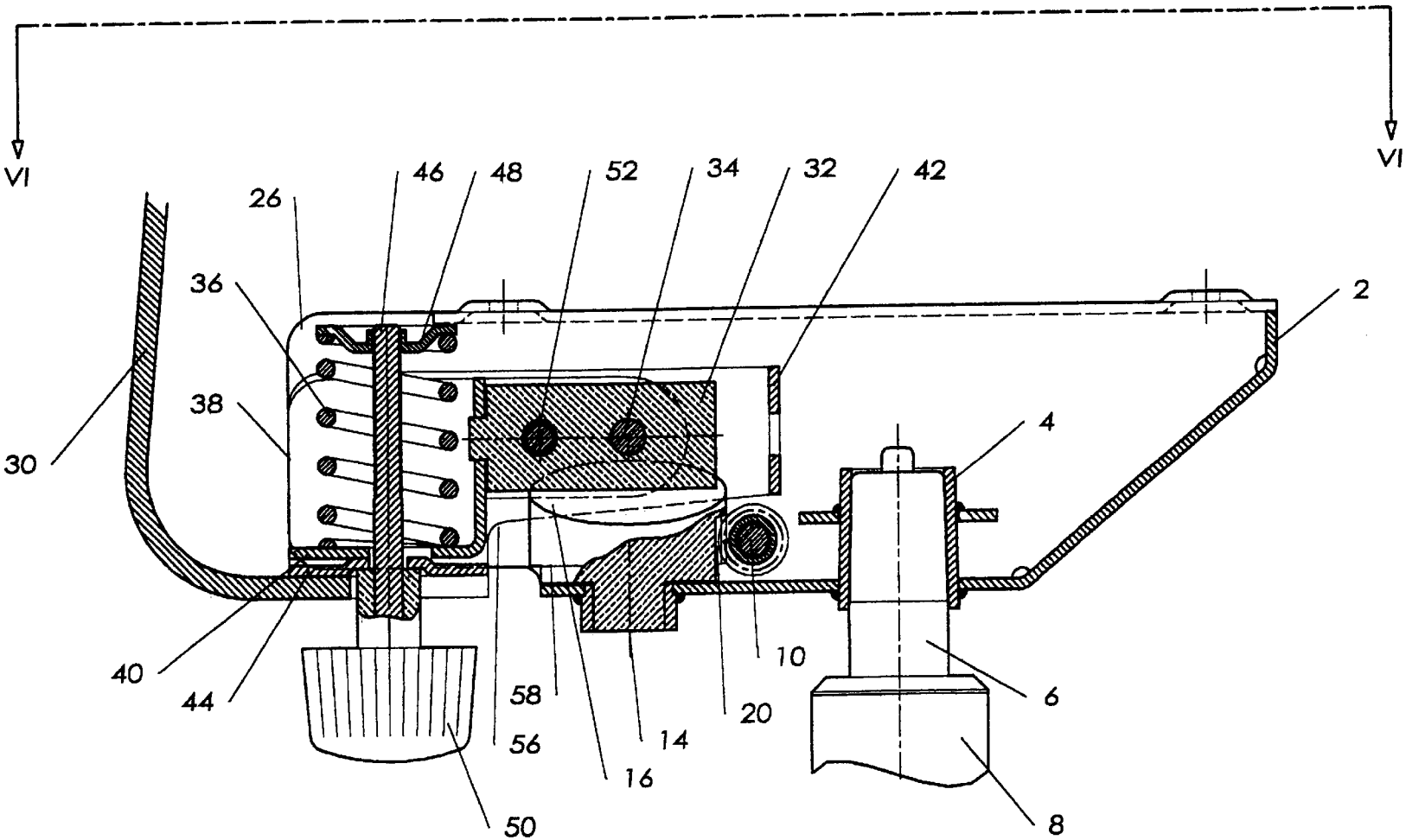
FIG. 5 is a longitudinal section through a second embodiment thereof taken on the line V—V of FIG. 6.
Figure 6:
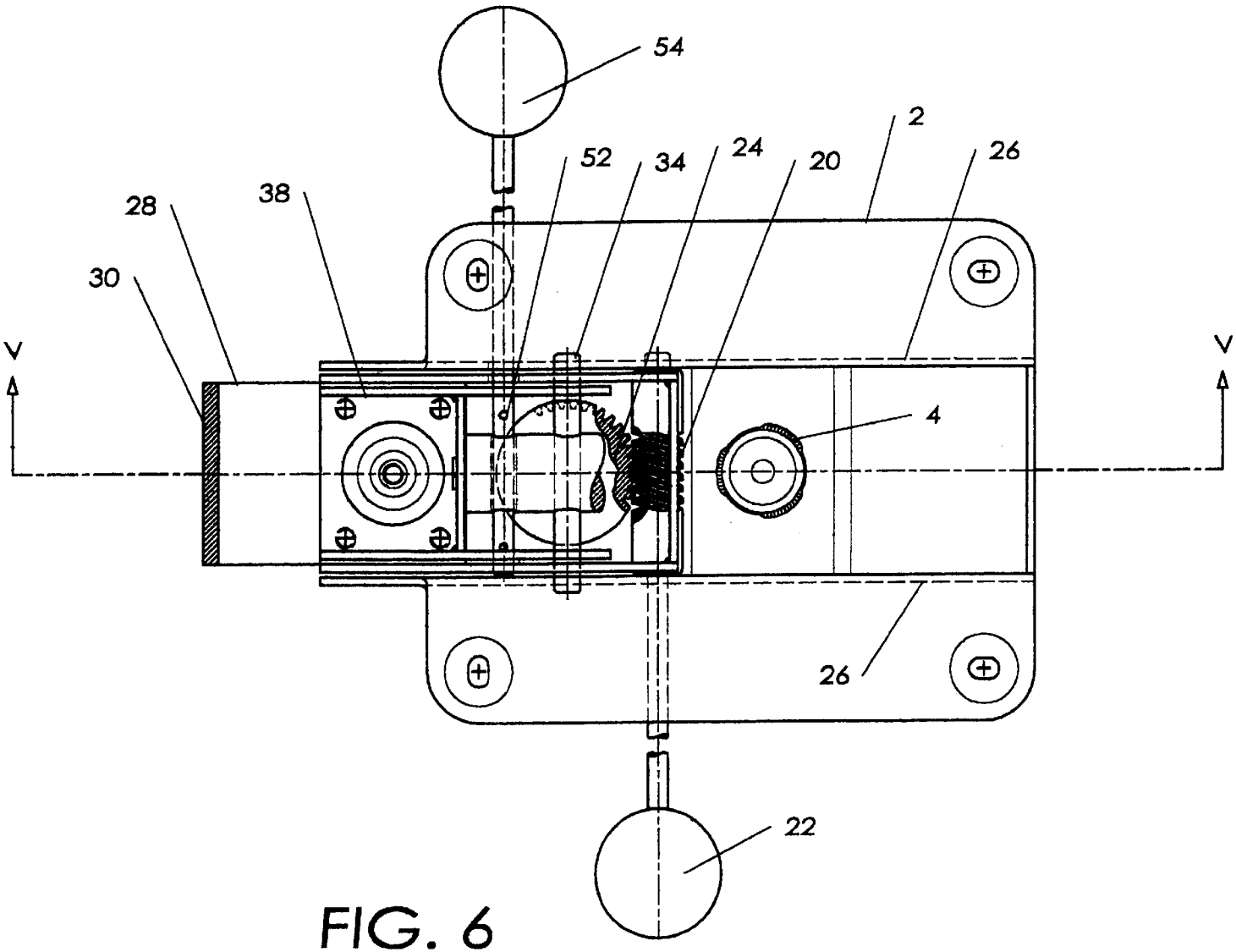
FIG. 6 is a plan view thereof to a reduced scale taken in the direction VI—VI of FIG. 5.
Figure 7:
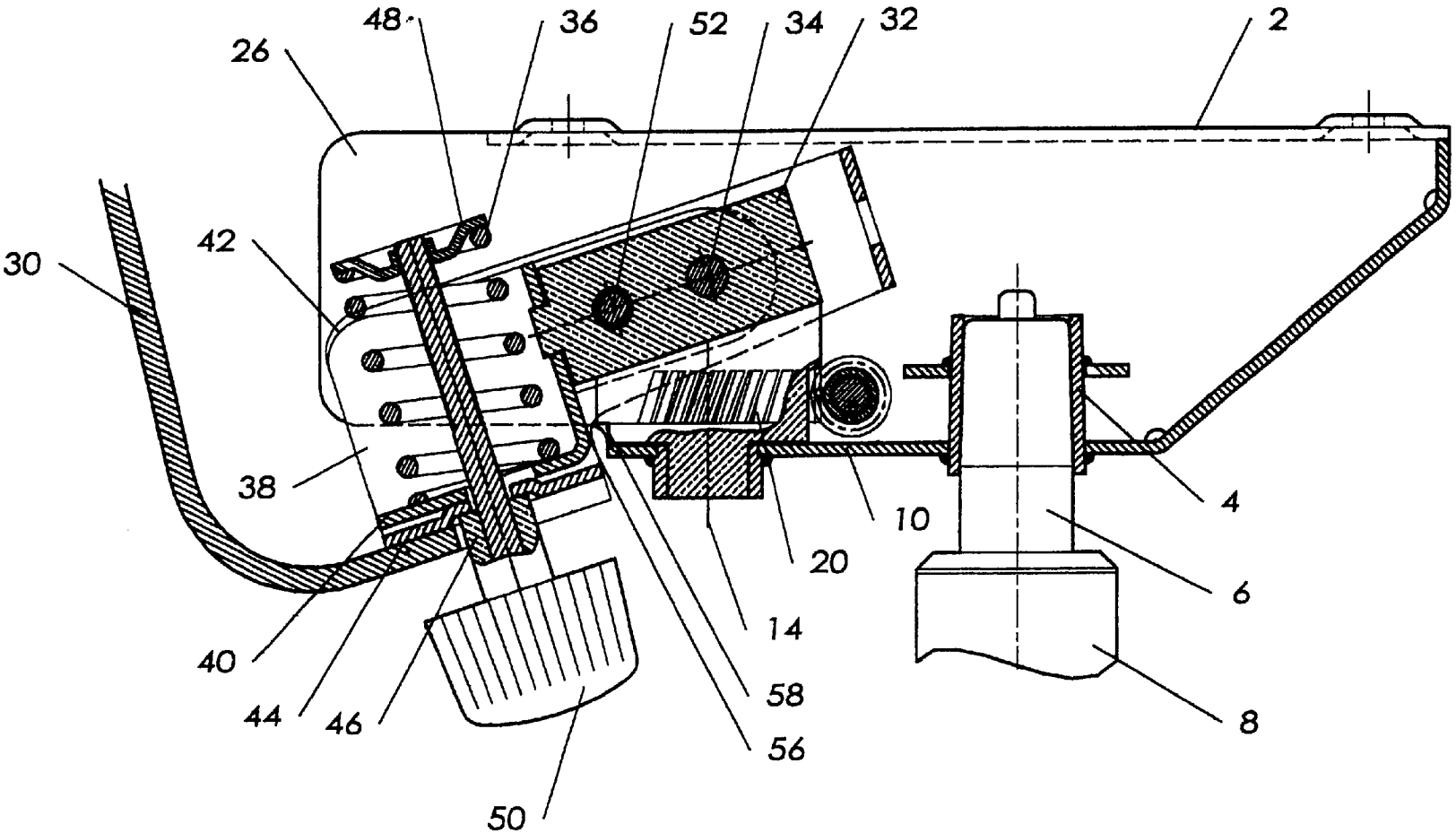
FIG. 7 shows the same view as FIG. 5 but with a different non-loaded inclination of the back-rest relative to the seating portion.
Figure 8:
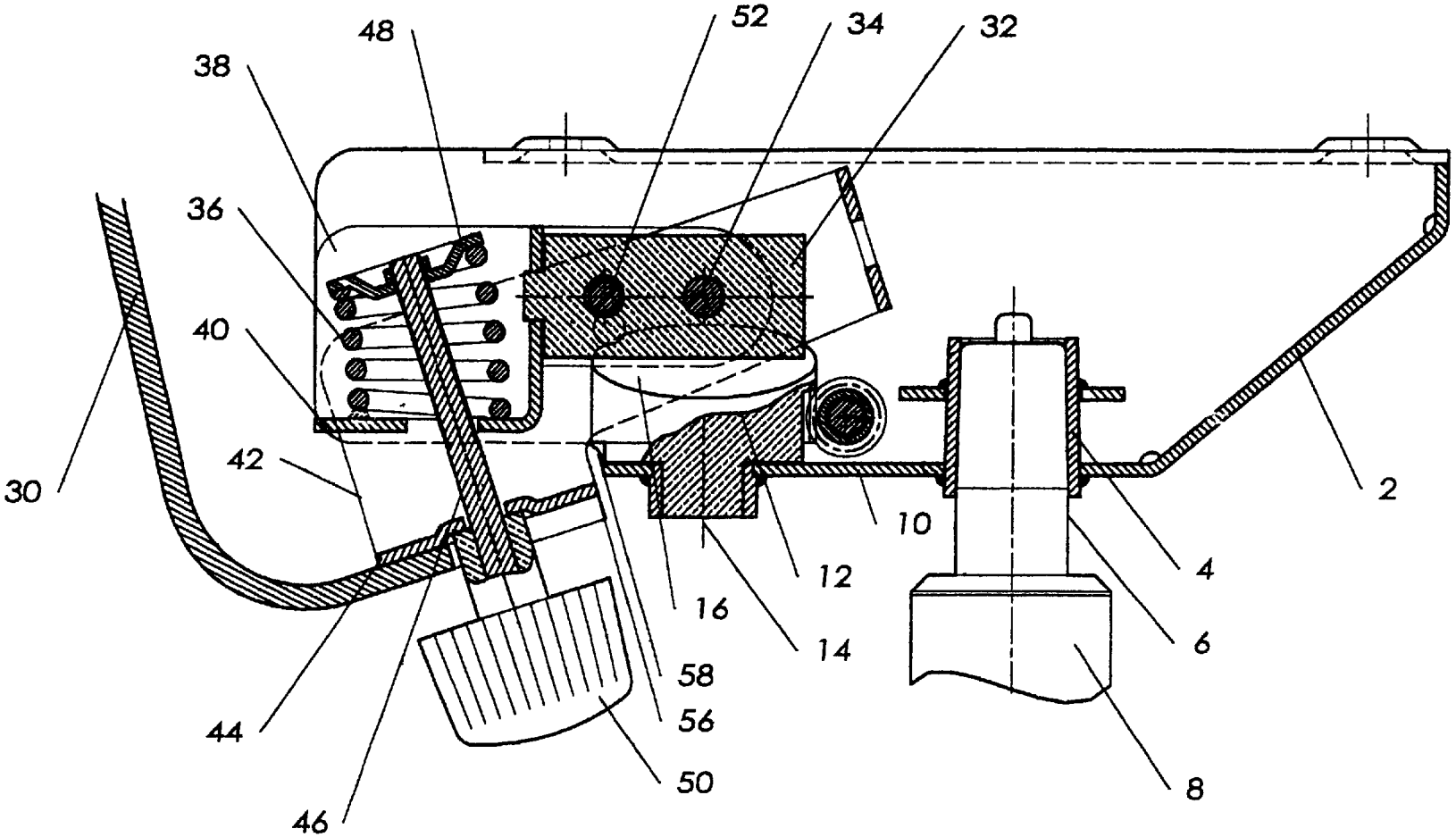
FIG. 8 shows the same view as FIG. 7 but with the back-rest urged elastically rearwards from its non-loaded condition.
Figure 9:
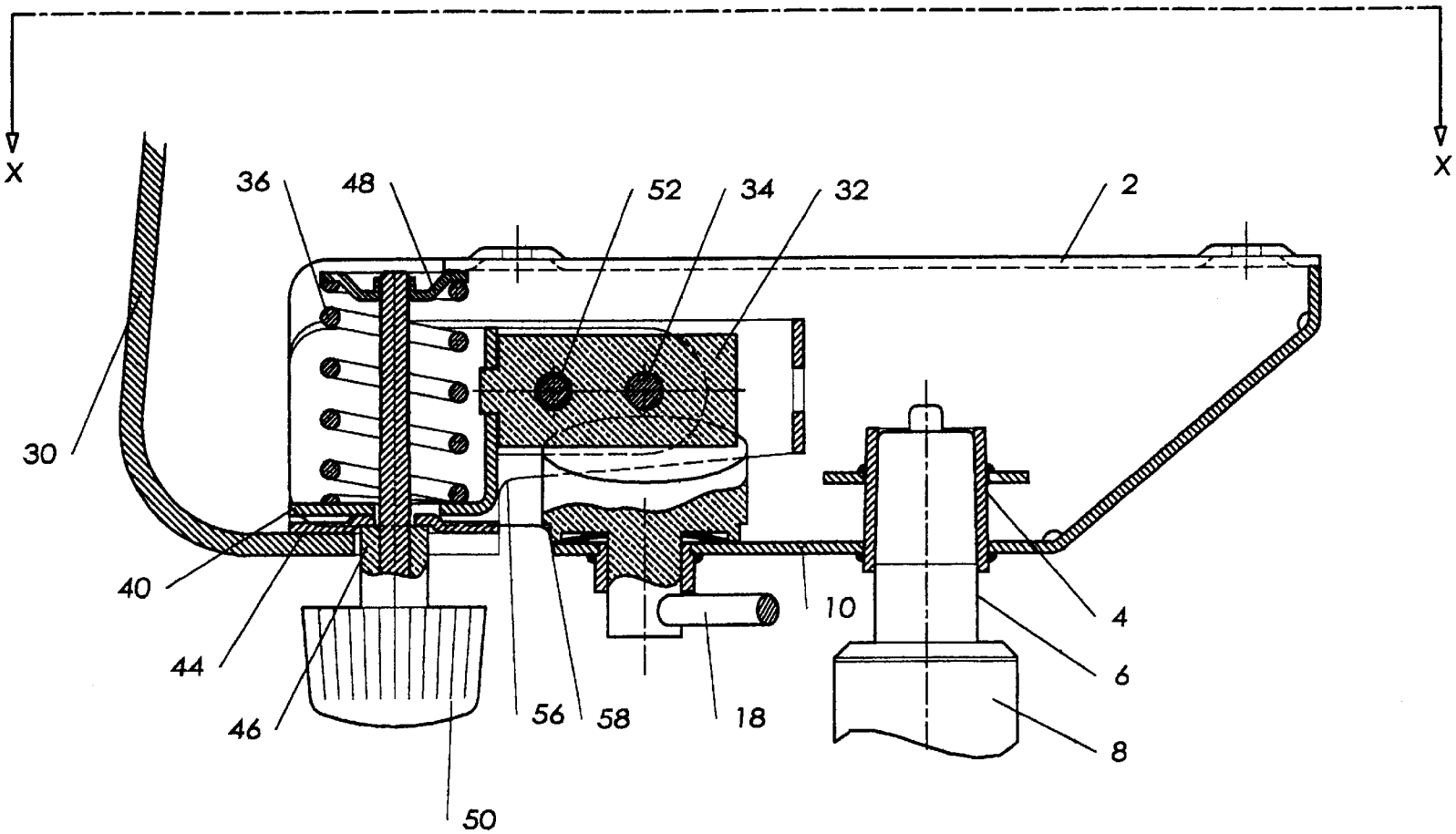
FIG. 9 shows the same view as FIG. 5 but with a different method of adjusting the inclination of the back-rest under non-loaded conditions.
Figure 10:
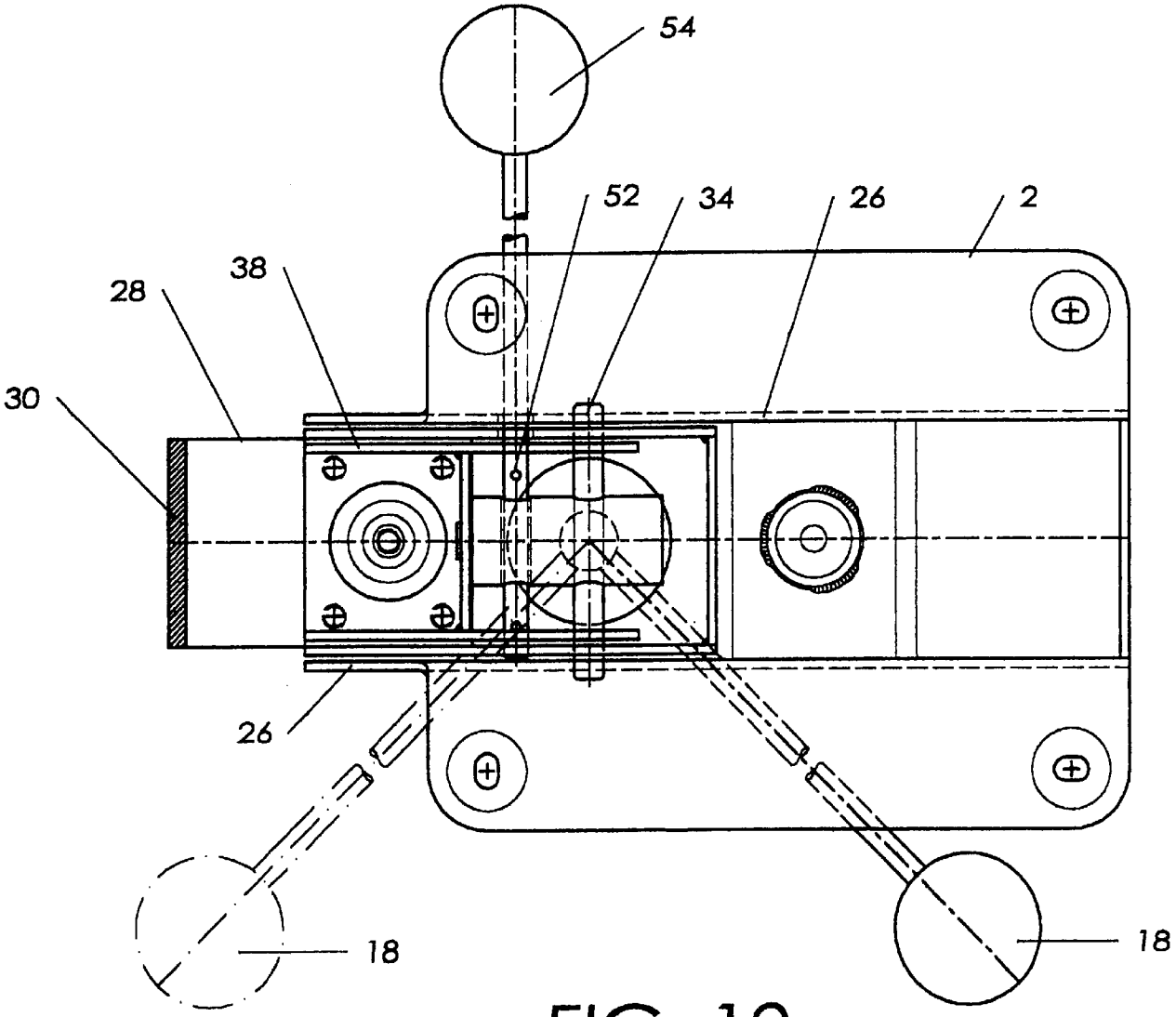
FIG. 10 is a plan view thereof to a reduced scale taken in the direction X—X of FIG. 9.

The cylindrical member 12 is able to rotate about its axis 14 relative to the box structure 2, either by direct command by means of a radical lever 18 rigid with its (see FIGS. 1–3) or by an indirect command via a worm coupling 20 rigid with an operating lever 22 and a ring gear 24 with the cylindrical member itself (see FIG. 4).

The box structure 2 is provided with two spaced-apart longitudinal shoulders 26, between which there is provided a second box structure 28, which extends rearward into a bracket 30 for supporting the back-rest (not shown).

The second box structure 28 supports a longitudinally arranged cylindrical member 32 resting against the inclined end 16 of the cylindrical member 12. The second box structure 28 is hinged to the box structure 2 at a transverse pin 34, which passes through the second box structure 28 and the cylindrical member 32 and engages two longitudinal shoulders 26 of the box structure 2.

The operation of the adjustment device according to the invention is based on the idea of utilizing the variation in inclination which occurs as the direction of the line of contact between a body and an inclined plane on which the body rests varies for adjusting the inclination of the back-rest to the seating portion.

Considering a cylindrical body which rests with one of its generating lines on an inclined plane, it is apparent that when the direction of this contact generating line varies, the axis of the cylindrical body varies in inclination from a maximum value, corresponding to the line of maximum slope of the inclined plane, to a minimum value corresponding to the line perpendicular to the line of maximum slope.

The application of this principle to the present case involves rotating the inclined plane, i.e., the inclined end 16 of the cylindrical member 12 rigid with the seating portion, and ensuring that for each angular position of the cylindrical member, the cylindrical member 32 rigid with the back-rest rests on the inclined end 16.

More specifically, the cylindrical member 12 is rotated about its vertical axis 14 either directly by the lever 18 or indirectly by the coupling between the worm 20 and the ring gear 24, via the lever 22.

Contact between the cylindrical member 32 and the inclined end 16 of the cylindrical member 32 is ensured by the fact that the axis of the hinge pin 34, i.e., the axis of articulation of the cylindrical member 12, intersects the axis of rotation of the cylindrical member 12.

In this manner, on operating the lever 18 or 22, the cylindrical member 12 rotates and with it its inclined end 16. As the cylindrical member 32 is compelled to remain in contact with the inclined end 16, the result is a variation in the inclination of the axis of this cylinder, and hence a variation in the rearward inclination of the back-rest.

If the cylindrical member 12 is rotated by operating the lever 18, the range of variation, corresponding to the maximum excursion of this lever, is limited for evident space reasons. The range of adjustment of the back-rest inclination can be varied by varying the inclination of the end 16 to the axis of the cylindrical member 12. However, it is preferable not to exceed a certain value of this angle, in order to prevent the force transmitted to the back-rest by the person seated, together with the inevitable small fluctuations in this force, resulting in a spontaneous movement of the seating portion towards the maximum inclination configuration.

If however the cylindrical member 12 is rotated by operating the lever 22 via the worm 20 or ring gear 24 coupling, by rotating the lever 22 always in the same direction, it is possible to obtain a continuous variation in the degree of inclination of the back-rest from its maximum to its maximum value, and back. The range of variation of the inclination of the seating portion from maximum to minimum value is related to the angle of inclination of the end 16 to the axis 14 of the cylindrical member 12.

By virtue of the new principle used, the device of the invention is particularly advantageous compared with traditional devices, and in particular:

- it achieves a smooth soft adjustment, without the need for force and without risk of breakage, in particular because it does not require a condition of balance between opposing forces to be attained;
- it involves simple mechanics, with no tensioning between mutually locked parts;
- it comprises a small number of parts, of very simple assembly.

In the embodiment shown in FIGS. 5–10, the principle of utilizing a coupling between a rigid body and a rotating inclined surface for adjusting the inclination of the back-rest relative to the seating portion remains the same. A device is proposed which also enables rearward elastic yielding of the back-rest to the achieved based on the force due to the thrust of the person seated on the chair.

More specifically, on the pin 34, supported by the two longitudinal shoulders 26 of the box structure 2, there are pivoted two boxes. A first box 38 rigidly carrying the cylindrical member 32 and provided with a base 40 on which the spring 36 rests, and a second box 42 which extends into the support bracket 30 for the back-rest and is provided with a base 44 traversed by a screw 46. The screw engages a disc 48 cooperating with the base 40 of the box 38 to retain the spring 36. A knob 50 is rigid with the screw 46 to regulate the preload of the spring 36, as explained hereinafter.

There is a locking bolt 52 operable axially by a lever 54 to lock the articulation between the two boxes 38 and 42 and hence prevent rearward elastic yielding of the back-rest.

When this articulation is locked, this embodiment behaves in a manner identical to the preceding. When the bolt 52 is deactivated, the operation of the device according to the invention is as follows:

when the user urges the back-rest rearward, the force received by the support bracket 30 is transmitted, via the base 44, the screw 46 and the disc 48, to the spring 36, which is axially compressed against the base 40. The base is fixed relative to the seating portion. In this manner the back-rest yields elastically rearward to an extent corresponding to the force transmitted by the user. This yielding is able to reach, at most, the end-of-travel position defined by a part of the box 42 (point 56) resting against the corresponding part of the box 2 (point 58).

When the elastic reaction of the spring 36 needs to be increased (for example in the case of a heavier user) it is only necessary to operate the knob 50 to vary the degree of preload of the spring 36.

This rearward elastic yielding of the back-rest and the adjustment of the degree of resistance to this yielding are totally independent of the no-load inclination position of the back-rest. This inclination is determined, as stated, by the angular position of the cylindrical member 12. However, as the rearward end-of-travel position of the back-rest by elastic yielding is related to the interference between the box 42 and the box 2, i.e., it does not involve the box 38 which supports the cylindrical member 32, the final rearward position of the back-rest after the elastic yielding is independent of the initial position of the back-rest, i.e., before yielding commences.

This second embodiment of the adjustment device is particularly advantageous, as it combines the advantages of the described adjustment system for the preceding embodiment with the following further advantages of the system for the rearward elastic yielding of the back-rest under the thrust of the user:

- no interference between the two systems and hence no stressing of the back-rest inclination adjustment members by the spring which opposes the rearward yielding of the back-rest;
- no risk of sudden elastic return of the back-rest into its erect condition by accidental or voluntary slakening of the seating portion/back-rest locking system when no operator is seated on the chair.

Figure 11:
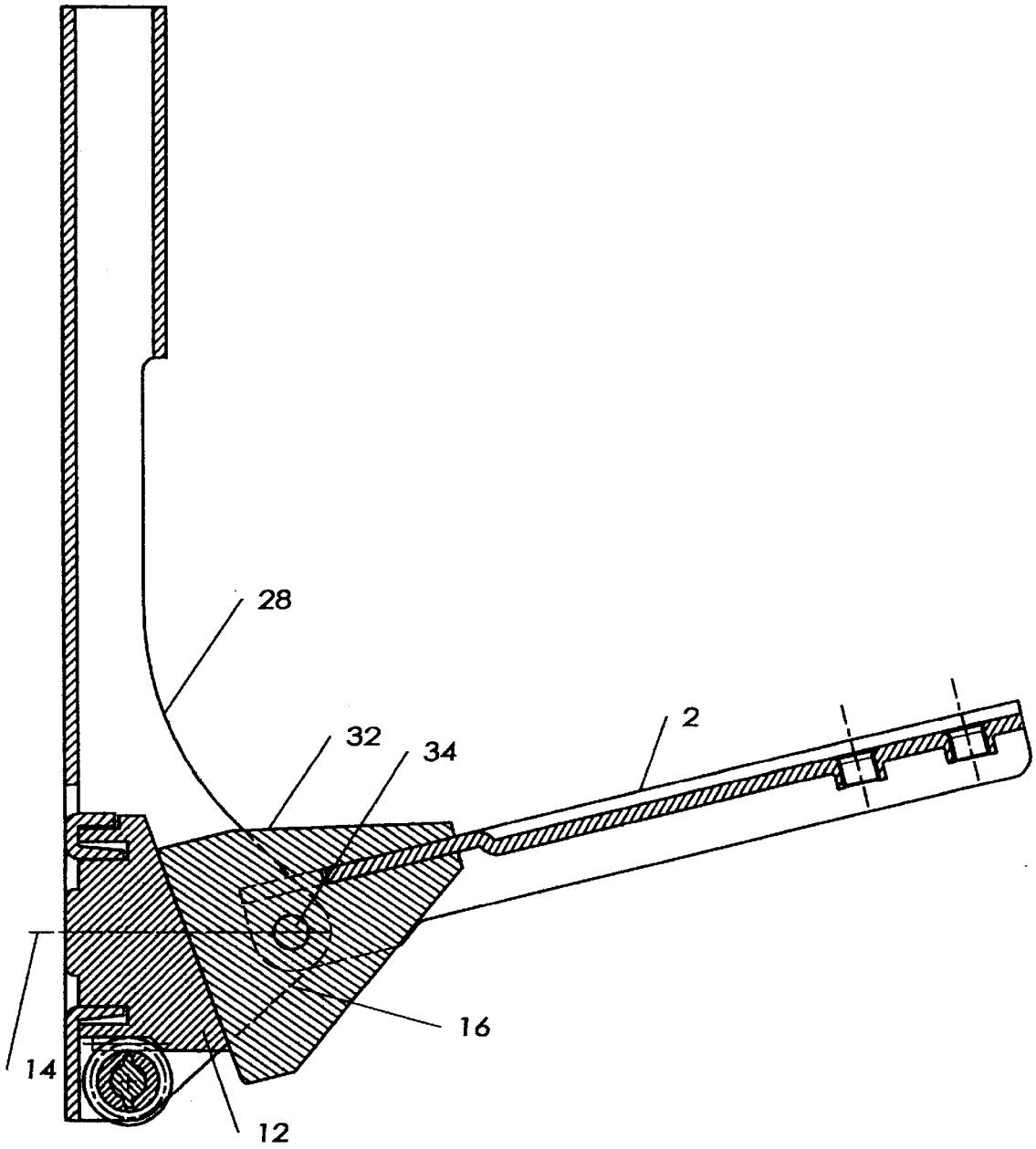
FIG. 11 shows a third embodiment.

In the embodiment shown in FIG. 11 the inclined plane 16 of the frusto-cylindrical sleeve 12 is provided on the back-rest portion 28 and cooperates with a partially cylindrical member 32 provided in the seating portion 2.

We claim:

1. A device which adjusts an inclination of a backrest to a seating portion in chairs in general, comprising a first structural element (2) rigid with the seating portion and a second structural element (28) rigid with the back-rest and hinged to the first structural element on a traverse hinging axis (34), characterised in that with one of the first and second structural elements (2, 28) there is attached a first member (12) provided with an inclined surface (16) and rotating about a rotational axis (14) which intersects said transverse hinging axis (34), with the other of the first and second structural elements (28, 2) there being attached a second member comprising at least one cylinder portion centered on a longitudinal axis and (32) maintained constantly with its circumferential surface resting on said inclined surface (16) along a line, for any angular position of said first member (12), the longitudinal axis of said cylinder portion (32) intersecting the point of intersection of the rotational axis of said first member (12) with the transverse hinging axis on which said first structural element (2) and said second structural element (28) are hinged together.

2. An adjustment device as claimed in claim 1 characterised in that the first member (12) is attached to the structural element (2) rigid with the seating portion and in that the rotational axis (14) is substantially vertical.

3. An adjustment device as claimed in claim 1 characterised in that the first member (12) is attached to the structural element (28) rigid with the back-rest and in that the rotational axis is substantially horizontal.

4. An adjustment device as claimed in claim 1, characterised in that a first member consists of a cylinder (12) with a flat lower end resting on the base (10) of the first structural element (2) and its upper end being inclined (16).

5. An adjustment device as claimed in claim 4, characterised in that a radial lever (18) is connected to the cylinder (12) to enable it to be rotated.

6. An adjustment device as claimed in claim 4 characterised in that a ring gear (24) on the cylinder (12) is coupled to a worm coupling (20) rigid with a lever (22) for rotational operation. inclined (16).

7. An adjustment device as claimed in claim 2, characterised in that the first structural element (2) comprises a pair of longitudinal shoulders (26) in which there engages a hinge pin (34) for hinged connection to the second structural element (28).

8. An adjustment device as claimed in claim 2, characterised in that the second structural element (28) comprises two boxes (38,42) hinged together on said transverse axis (34), a first box (38) of said two boxes being rigid with the second member (32) and being provided with a first base (40) on which one end of an elastic member (36) rests, the second box (42) being rigid with the back-rest (30) and being provided with a disc element (48) against which the other end of said elastic member (36) rests.

9. An adjustment device as claimed in claim 8, characterised in that the elastic member (36) consists of a coil spring of an adjustable preload.

10. An adjustment device as claimed in claim 8, characterised in that with the second box (42) there is connected a screw member (46) provided at one end with an adjustment know (50) and engaging at its other end in said disc element (48), said disc element cooperating with said first base (40) to retain said spring (36).

11. An adjustment device as claimed in claim 8, characterised by comprising means for locking the articulation between the two boxes (38,42) of said second structural element (28).

12. An adjustment device as claimed in claim 11, characterised by comprising a locking bolt (52) movable axially under the control of a lever (54) and passing thgrough both boxes (38,42) by way of holes provided in at least one facing lateral wall of each of said two boxes.

* * * * *